United States Patent [19]

Salomon

[11] 4,334,367

[45] Jun. 15, 1982

[54] PROCESS FOR MANUFACTURING A SPORTS SHOE AND THE SHOE ITSELF

[75] Inventor: Georges P. J. Salomon, Annecy, France

[73] Assignee: Ets. Francois Salomon et Fils, S. A., Annecy, France

[21] Appl. No.: 103,066

[22] Filed: Dec. 12, 1979

[30] Foreign Application Priority Data

Dec. 13, 1978 [FR] France ..... 78 35079

[51] Int. Cl.[3] ..... A43B 5/04; A43D 9/00

[52] U.S. Cl. ..... 36/117; 36/114; 12/142 P

[58] Field of Search ..... 36/117, 118, 119, 120, 36/121, 114, 133; 12/142 R, 142 J, 142 K, 142 P, 142 T

[56] References Cited

U.S. PATENT DOCUMENTS

| | | | |
|---|---|---|---|
| 3,748,951 | 7/1973 | Orndorff | 36/32 R |
| 3,851,410 | 12/1974 | Frazier | 36/133 |
| 4,106,223 | 8/1978 | Benseler | 36/117 |
| 4,174,121 | 11/1979 | Benseler | 36/117 |
| 4,235,452 | 11/1980 | Linecker | 36/117 |
| 4,246,708 | 1/1981 | Gladek | 36/117 |

FOREIGN PATENT DOCUMENTS

| | | | |
|---|---|---|---|
| 162005 | 4/1948 | Austria | 36/114 |
| 2803552 | 2/1979 | Fed. Rep. of Germany | 36/117 |
| 2345181 | 10/1977 | France . | |

*Primary Examiner*—Patrick D. Lawson

*Attorney, Agent, or Firm*—Sandler & Greenblum

[57] ABSTRACT

A process for making a shoe for use in conjunction with various sports. The shoe comprises an upper portion, a walking sole, an intermediate element and at least one projecting portion. The process comprises the steps of integrating the projecting portion together with the intermediate element to form an integral assembly and then integrating the integral assembly with the upper portion and the walking sole to form the shoe.

35 Claims, 11 Drawing Figures

FIG. 3
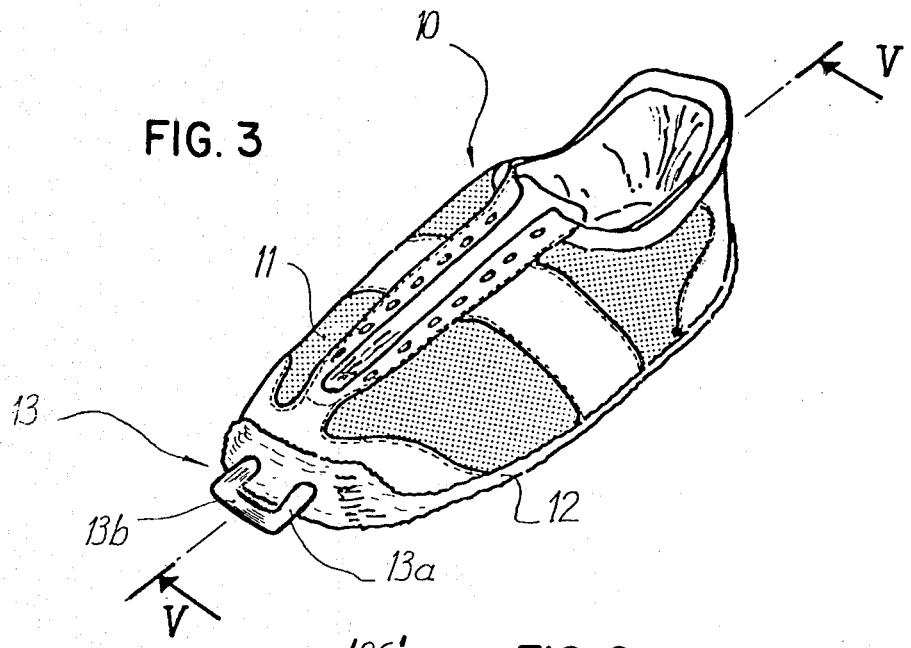
FIG. 6
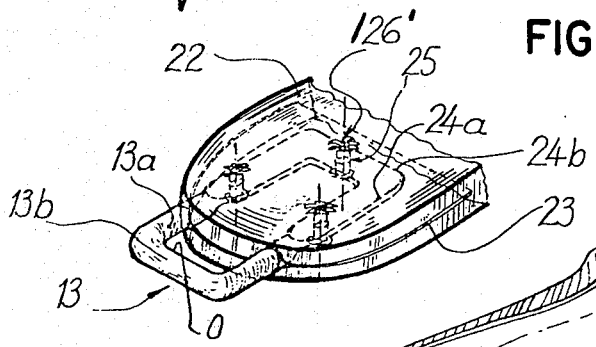
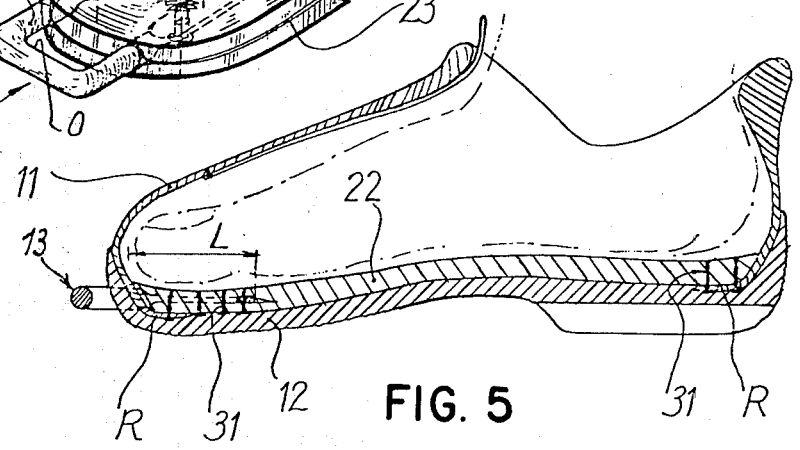
FIG. 5

PROCESS FOR MANUFACTURING A SPORTS SHOE AND THE SHOE ITSELF

BACKGROUND OF THE INVENTION

1. Field of the Invention

The present invention relates to the manufacture of sports shoes comprising at least one portion projecting to the exterior of the shaft and/or of the sole and to shoes comprising such a projecting portion.

2. Discussion of Prior Art

Shoes provided with portions (or appendices) which project are known, such as athletic shoes provided with spikes under the sole, shoes for mountain climbing whose ends are equipped with spikes or spurs, shoes for use in competitive cycling comprising supports, ski boots, and particularly boots for use in mountainer skiing and cross-country skiing, etc.

In general, the projecting portions or appendices are attached to the lower or walking sole and as a result of this positioning, certain disadvantages result, both with respect to the comfort of the wearer and particularly with respect to the shoe itself. In effect, in these types of known shoes, the walking sole is subjected directly to intense mechanical effects (shear, traction, flexion), particularly in the linking regions between the sole and the projecting portions or appendices. These forces, with time, may possibly result in the deterioration of the sole and cause the separation of the sole from the projecting portions or appendices.

What has been noted above applies for all sports shoes of this type and more particularly for sports shoes used in cross-country or touring skiing, which are presently available on the market. These known cross-country ski boots are generally provided with a flexible walking sole comprising an extension on its front which is adapted to cooperate with the cross-country ski binding. This extension, which serves as a flexible blade, must allow for good movement of the foot during cross-country skiing. Yet, this solution suffers from certain disadvantages which relate to the operation of this flexible blade which is connected to the binding by a sort of pincer resting on the blade along a surface transverse to the longitudinal axis of the sole. As a result, the flexion blade used in this manner does not allow for optimum advancement of the foot, because, the frictional axis constituted by the surface of the squeezing pincer is situated too far ahead of the foot and thus increases the radius of movement as the foot is raised. Furthermore, the sole of this type of boot is subjected to mechanical forces essentially in the zone of the extension forming the flexion blade which, inter alia, necessitates the use of a sole material which is particularly resistant to fatigue and which exhibits good mechanical characteristics. Such soles are expensive and are nevertheless subject to deterioration.

French Pat. No. 2,345,181 (77 08705) discloses a ski boot comprising a sole made essentially out of rubber or other synthetic material. A metal armature 7 is arranged within the cross section of the sole. The armature extends from the heel of the boot up to the front of the projection portion.

SUMMARY OF THE INVENTION

In its most general aspect, the present invention overcomes the above disadvantages.

The previously recited disadvantages of the prior art are overcome by the process of the invention for making a shoe or boot finding use in different sports which comprises an upper portion, a walking sole joined at its perifery to the upper portion at a junction, and an intermediate element positioned between the walking sole and the region adapted to receive the foot of the user. At least one portion is provided which projects beyond the junction. The process of the invention comprises the steps of integrating the projecting portion and the intermediate element to form an integral assembly, and integrating the integral assembly with the upper portion and the walking sole to form the shoe.

The projecting portion itself may form part of an inlaid element such that the process may further comprise inlaying the inlaid element within the intermediate element whereby a portion of the inlaid element is inlaid within the intermediate element and the projecting portion of the inlaid element protrudes beyond the junction. In this instance, the intermediate element may comprise a seat or other means adapted to receive the inlaid portion of the inlaid element such that the inlaid portion can be mechanically secured within the seat.

The intermediate element can be molded so as to encase the inlaid portion of the inlaid element therein. The walking sole may itself be molded around the intermediate element comprising the inlaid element.

So as to prevent folds and creases when the front lower portion of the upper portion of the shoe is folded under the intermediate element, the process of the invention comprises slitting the lower front portion of the upper portion to provide at least one slit.

The boot or shoe of the invention may further comprise at least a portion of a "first to be mounted" or first sole. An auxiliary support may be positioned between the first sole and the walking sole. The intermediate element itself may comprise at least one cavity adapted to anchor the walking sole. The inlaid portion of the inlaid element is anchored within the front portion of the intermediate element positioned at the front of the shoe or boot and the projecting element may, therefore, be positioned substantially in the plane of the intermediate element so as to extend along the longitudinal axis of the boot or shoe.

By virtue of its unique structure, the boot or shoe finds particular application in cross-country and mountaineer type skiing and may be used in conjunction with bindings commonly used in these sports wherein the rear of the boot is lifted off the surface of the ski. When used as such, the ski binding comprises a bearing adapted to seat the projecting element which is itself rigid and defines a plane having an opening extending through the plane of the element. The projecting portion may be generally U-shaped so as to comprise two longitudinal branches connected by one transverse branch. The various branches of the projecting portion may have a generally circular cross-section adapted to be seated in the bearing. The projecting portion may itself be part of an inlaid element in the form of a generally rectangular ring. The inlaid portion of this ring may have flattened cross-section.

BRIEF DESCRIPTION OF THE DRAWINGS

The invention will be described below with reference to the annexed drawings illustrating exemplary non-limiting embodiments of the invention, in which:

FIG. 3 illustrates a perspective view of a first embodiment of a boot according to the invention which is adapted for cross-country skiing or mountaineer skiing;

FIG. 5 is a longitudinal cross-sectional view along line V—V of FIG. 3;

FIG. 6 is a perspective detailed view of FIGS. 3 and 5;

DESCRIPTION OF PREFERRED EMBODIMENTS

Figure 1:
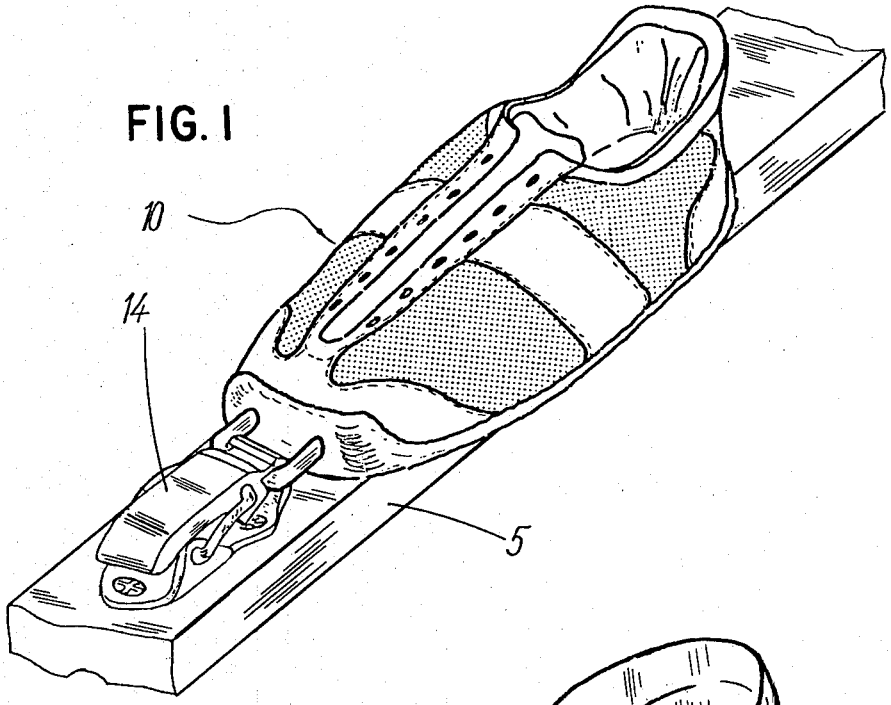
FIG. 1 illustrates a perspective view of a first embodiment of a shoe according to the invention adapted for cross-country skiing, cooperating with a cross-country ski binding.

The ski boot of the invention overcomes the above recited problems and relates, in the first instance, to a process for manufacturing a shoe or boot for use in various sports comprising in a conventional fashion an upper portion, a walking sole connected at its periphery to the upper portion, an intermediate element arranged between the walking sole and the foot within the shoe, and at least one portion projecting towards the exterior with respect to the volume defined by the upper portion and the sole where the foot of the user is inserted. The process comprises the steps of assembling the intermediate element with the projecting portion in a fashion such that they form an integral assembly; and making the intermediate element, equipped with the projecting portions, integral with the upper portion of the shoe and walking sole.

In a preferred embodiment of the invention, the projecting element constitutes a portion of an inlaid element attached to the intermediate element. An inlaid portion of the inlaid element is maintained on the interior of the intermediate element while the projecting portion of the inlaid element extends beyond the exterior of the intermediate element.

The connection between the inlaid element and the intermediate element can be fashioned either by molding the intermediate element around the inlaid element, or by providing within the intermediate element a space in which one introduces and fixedly secures a portion of the inlaid element by any appropriate means such as rivets, staples, adhesive, etc.

Preferably, the walking sole may be molded around the intermediate element equipped with the inlaid element and will assure the cohesion of this assembly with the upper portion of the shoe.

The invention also relates to sports shoes manufactured according to the above process, which themselves comprise an upper portion, a walking sole, an intermediate element arranged between the walking sole and the foot of the user, and at least one portion projecting towards the exterior with respect to the volume defined by the upper portion of the shoe and the sole. The projecting portion is assembled directly onto the intermediate element in a fashion so as to form an assembly integral with the intermediate element while the intermediate element is connected to the upper portion of the shoe and the walking sole.

The intermediate element may itself comprise either at least a portion of a sole normally found on the interior of shoes and conventionally known as "first to be mounted" or first sole or by an assembly comprising a first sole associated with an auxiliary element attached to the first sole and adapted to be wedged between the first sole and the walking sole.

With the context of certain applications (mountain climbing boots, cross-country ski boots or mountaineering ski boots), the inlaid element is anchored in this front portion of the intermediate element situated at the front of the boot and extends in the plane of the intermediate element and extends substantially along the longitudinal axis of the shoe or boot.

In the particular case where a shoe according to the invention is adapted for the practice of cross-country skiing or mountaineering skiing and adapted to cooperate with a ski binding comprising a journal element in which is adapted to be engaged the inlaid element at the end of the shoe, the inlaid element is rigid and defines a planar surface comprising along its portion exterior to the shoe, at least one opening or orifice which extends to both sides of the plane of the inlaid element.

By virtue of this arrangement, the connection of the shoe to the cross-country ski binding is improved such that the movement of the foot during the practice of this sport is carried out along a real axis and so that it is possible to thereby use walking sole materials which are at least expensive while nevertheless meeting the desired operating specifications. In an advantageous manner, the connection means which comprise the inlaid element arranged on the shoe according to the present invention are provided, for example, so as to cooperate with a binding for a boot on a ski of the type described by the applicant in U.S. patent application Ser. No. 87,780 filed on Oct. 24, 1979, and entitled "SKI BINDING AND BOOT", the disclosure of which is hereby incorporated by reference.

According to a particular aspect of the invention, the downhill ski boot fashioned as described above can comprise at least one rigid inlaid element having various configurations and constituted by diverse materials, as long as these materials possess the required mechanical characteristics necessary for the invention.

According to a preferred embodiment of the invention, the cross-country ski boot comprises a shaft mounted on an internal sole known as the "first to be mounted" in a known fashion. Nevertheless, the said first to be mounted comprises one rigid inlaid element extending towards the front of the shoe in the longitudinal direction. This regid element is anchored directly in the cross-section of the first to be mounted, either by means of rivets, molding, etc., such that the inlaid element and the first to be mounted form a unique and fully integrated assembly. So as to facilitate the mounting of the upper portion of the shoe on the first to be mounted, the upper portion comprises one or more openings conforming to the shape of the inlaid element extending to the exterior of the boot. A walking sole is molded over the assembly comprising the upper portion and the first sole while leaving the end of the inlaid element free and assuring the sealing of the boot as well as the various characteristics necessary for practicing cross-country skiing and/or mountaineering skiing.

Advantageously, the inlaid element has a buckle-shaped configuration of a U-shaped configuration, and is made out of a rigid material such as steel, for example, whose central branch of the projecting portion acts as a journal axis and assures the cooperation with the binding. Quite clearly, the inlaid element may assume different configurations similar to that of the extensions of the boots used in cross-country skiing and mountaineering skiing presently used. In a like fashion, the first sole can be fashioned out of one or more portions which may be superimposed in layers or assembled end to end, without this constituting a limitation to the scope of the invention as long as the inlaid element is connected in a rigid fashion to this first sole.

According to an alternative embodiment of the invention, a boot used in cross-country skiing comprises an upper portion mounted on a first sole in a known fashion, but differs with respect to the previous embodiment in that the inlaid element adapted to cooperate with the binding is no longer mounted directly on the first sole, but is assembled with this first sole by means of an auxiliary support in the cross-section of which the inlaid element is anchored. This type of construction avoids the necessity of providing openings in the end of the upper portion to allow for the passage of the inlaid element through the wall of the boot, which results in improved sealing characteristics. The auxiliary support comprising the inlaid element is assembled to the first sole on which is mounted the upper portion and a walking sole made out of a flexible material which encases by molding, for example, the entire previously described assembly.

As in the embodiment described above, the rigid inlaid element can assume diverse configurations resulting in a journal axis substantially transverse to the longitudinal axis of the shoe. The anchorage of the inlaid element in the auxiliary support can be achieved by any rigid assembly means ensuring good cohesion between the inlaid element and the support. The support can advantageously extend along the entire length of the first sole and an may comprise empty portions or cavities, in the case of a molded element, resulting in a lightened weight of the assembly.

Figure 2:
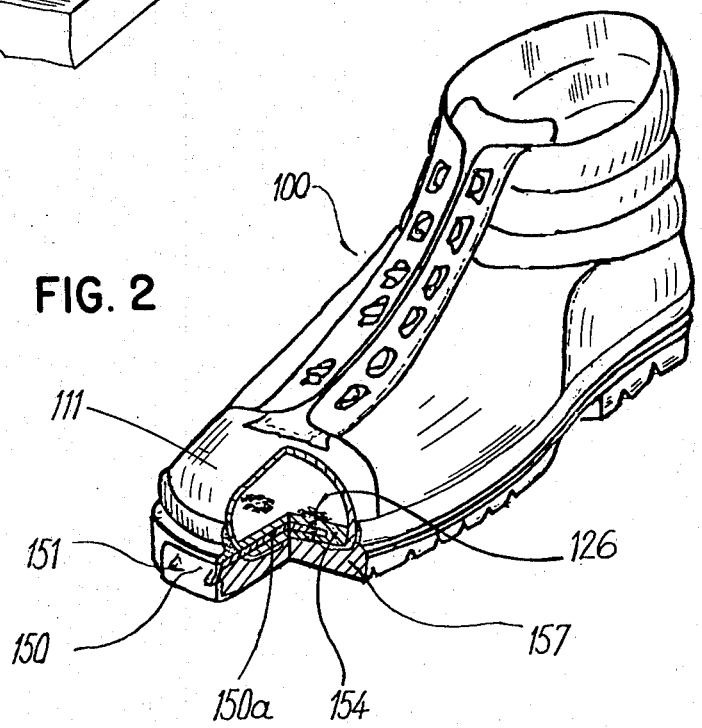
FIG. 2 illustrates a partial cross-sectional view of a mountain climbing boot equipped with climbing spurs, the boot being formed in the manner of the invention.

FIG. 2 illustrates how the present invention may be applied to all sports shoes equipped with a portion or appendage projecting with respect to the shoe itself, although the invention finds particular application with respect to shoes and boots used in cross-country skiing and mountaineering skiing.

The boot shown in FIG. 2 illustrates a mountain climbing boot 100 for example, whose sole has at its front end, a projecting portion 150, provided with spikes 151 acting as climbing spurs. This projecting portion is preferably made out of high quality steel such that this projecting portion is resistant to wear, shocks, etc., and is inserted, according to the invention, in an intermediate element comprising an interior sole 154 known as the "first to be mounted" or first sole of the shoe in a manner which will be described below with reference to FIG. 6.

Assembly means such as rivets 126 solidly maintain portion 150 by its planar zone 150*a* in the first sole. The upper portion 111 of the boot 100 is assembled to the assembly constituted by the portion 150 and the first to be mounted 154 by known means, not shown. A cutaway is provided in the upper portion to allow for passage of portion 150 towards the exterior of the upper portion. The walking sole 157 which is subsequently molded ultimately assures the cohesion and sealing of the boot thus manufactured.

The invention will now be described in further detail, by way of non-limiting reference to the cross-country ski or mountaineering boots, of which several forms, are shown in FIGS. 1 and 3 through 11.

The boot has been generally designated by reference 10 and the upper portion or upper is identified as 11 in all of the drawings.

As may be seen with reference to FIG. 3, the boot has a walking sole 12, preferably made out of an elastomeric material (in the examples shown), molded in accordance with known techniques over the inner periphery of the upper portion.

In front and substantially along the longitudinal axis of the boot, the walking sole comprises a U-shaped inlaid element 13 which projects to the exterior of the boot. This element 13 can have any appropriate configuration and can be fashioned out of any appropriate rigid material. In the examples shown, element 13 is shown as a one-piece or monoblock steel ring having a generally rectangular shape whose projection portion exterior to the shoe has a generally circular cross section, while the portion anchored in the boot is flattened. As may be seen in FIG. 6, the exterior portion of the ring has two lateral arms or branches 13*a* connected by a transverse branch 13*b* which, together with the point of the shoe or boot, defines an orifice or opening O whose purpose will be described below.

The portion of the ring anchored in the boot likewise has two lateral arms 24*a* connected by a transverse arm 24*b*, these portions being flat and perforated with orifices 25 allowing for element 13 to be made integral with the portion of the boot which will carry it and which is generally designated herein as an intermediate element. In FIG. 6, this integration is achieved by rivets 126' which extend through the intermediate element 22 and the holes 25 provided in the element 13. It will, however, be understood that one can provide other integration means such as, for example, nails, adhesives, etc.

Figure 4:
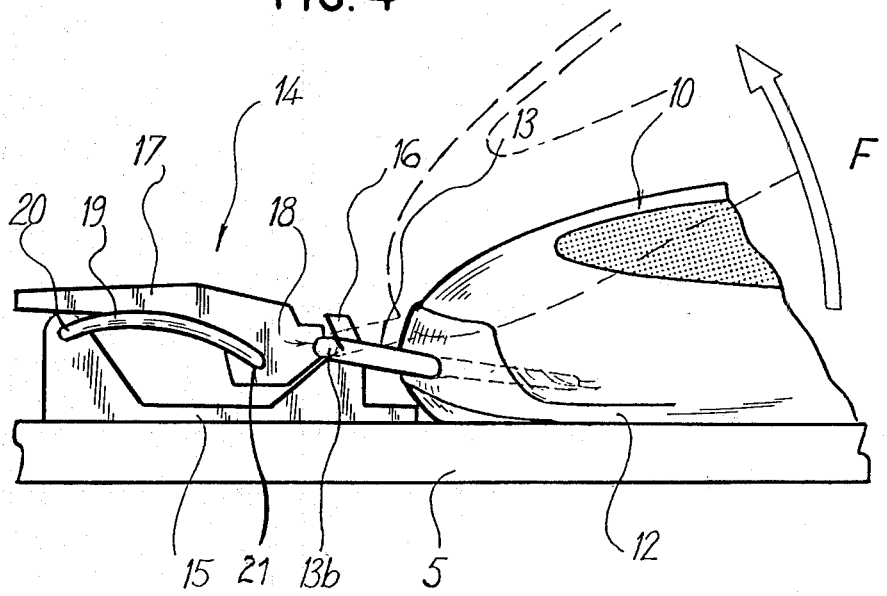
FIG. 4 schematically illustrates the boot of FIGS. 1 and 3 cooperating with a cross-country ski binding.

The ring 13 used in the boot is adapted to cooperate, as shown in FIG. 4, with a cross-country ski binding of a type such as described in the patent application in the name of Applicant referred to above. For purposes of this application, this binding will be briefly and succinctly described (FIG. 4).

On the ski 5 is attached a base 15 having a vertical flange 16 transverse to the longitudial axis of the ski and having a substatially V-shaped profile adapted to serve as a journal for the transverse arm 13*b* of the element 13. The transverse arm is immobilized with respect to the base 15 while being pivotable around its axis by virtue of a movable pressure element generally designated as 14. The pressure element comprises a lever 17, comprising a cylindrical seat 18 adapted to seat against the transverse element 13*b*, and an elastically deformable stirrup 19 journalled between axis 20 on base 15 and axis 21 on pressure element 14. The lateral arms of the stirrup are free to turn in the bearing such that the boot can be raised in the direction indicated by arrow F. It will be noted that the element 14 may be opened by virtue of lever 17 to free the boot.

Figure 7:
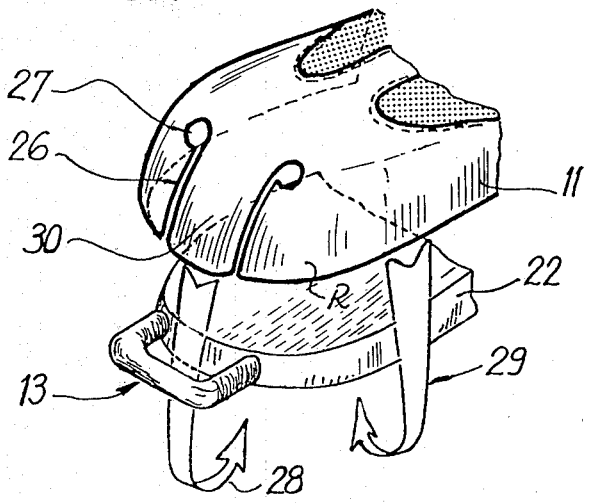
FIG. 7 is a perspective view illustrating the mounting of a portion of the boot of FIGS. 3, 5 and 6.

As has been previously shown, the inlaid element 13 is anchored in an intermediate element of the boot arranged between the walking sole and the foot of the user. As shown in FIGS. 5 through 7, the intermediate element comprises an interior sole 22 of the shoe commonly known as a "first to be mounted" or first sole.

In FIG. 6, it may be seen that to assemble element 13 and the first sole 22, the front portion of the first sole 22 has been split along its cross-section so as to provide a seat 23 in which the flat portion 24*a*–24*b* of element 13 is inserted. The rivets 25 extending across the sole 22 and the element 13 assure the connection of the assembly. It will be noted that, preferably, the length "L" of the anchorage of the element 13 in the sole will be substantially equal to the average length of the phalanges of the big toe so as to not disturb the flexion of the foot and the boot when walking normally.

In FIG. 5, it is seen that the peripheral edge of the upper portion 11 of the shoe is bent at R under the first sole 22, and is connected to this mounting by appropriate connection means 31, such as nails or staples.

In this case, it is preferred, to allow for this type of mounting, by providing on the upper portion 11 two slits 26 (see FIG. 7), ending at holes 27 so as to allow for the passage of element 13. Thus, when one mounts the upper portion in the direction of arrows 28 and 29 of FIG. 7, the small tongue 30 engages itself in the ring and one can bend the edge R of the upper portion under the first sole, the presence of the slits 26 further allowing for the avoidance of formation of folds or wrinkles at the level of the bent-under portion.

Figure 8:
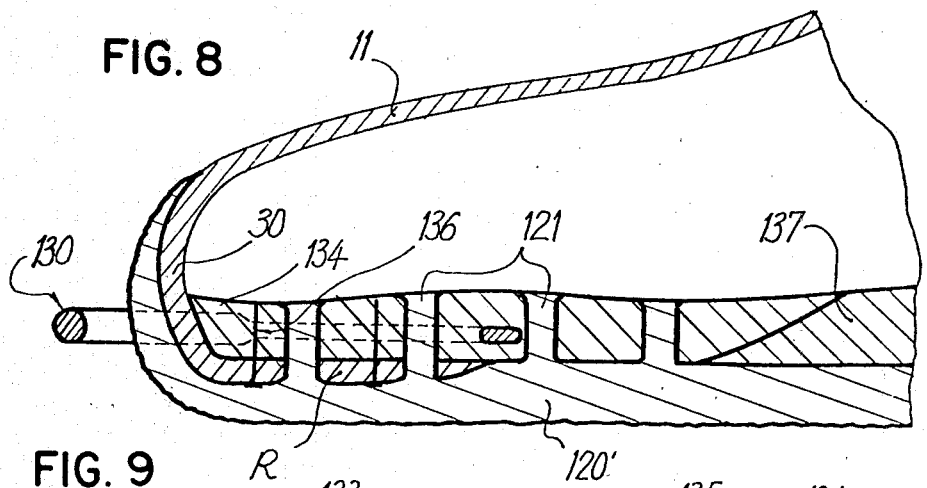
FIG. 8 illustrates a longitudinal cross-sectional view of the front end of a second embodiment of a ski boot for use in cross-country skiing or mountaineer skiing.
Figure 9:
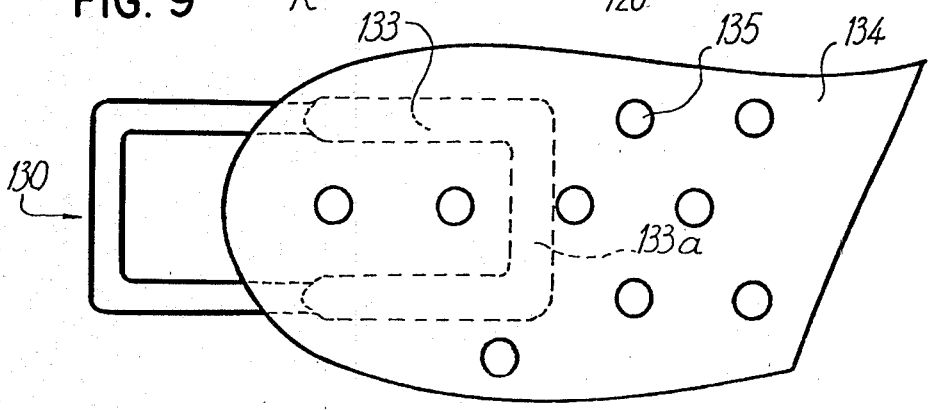
FIG. 9 is a top view of the intermediate element of FIG. 8 provided with the inlaid element.

In an alternative embodiment, the inlaid element 130 can be made integral with the first to be mounted 134, or a portion thereof, by molding as shown in FIGS. 8 and 9. In this embodiment, the first to be mounted comprises two portions 134 and 137 mounted end to end in the boot. The portion 134 molded on the flat portion 133 and 133*a* of the inlaid element is, as in the preceding case, connected to the bent-down edge R of the shaft by nails 136 or staples. By virtue of the fact that the edge R is bent under the portion 134, the upper portion can be provided with slits 26 as shown in FIG. 7.

Furthermore, one may advantageously provide in portion 134, nails 135 extending onto both sides of portion 134, as in the example shown, or simply provided in the lower face without extending onto the upper face.

During the molding operation of the walking sole 120', the material constituting the walking sole will fill holes 135, thus resulting in an anchorage of the elements forming the boot.

Figure 10:
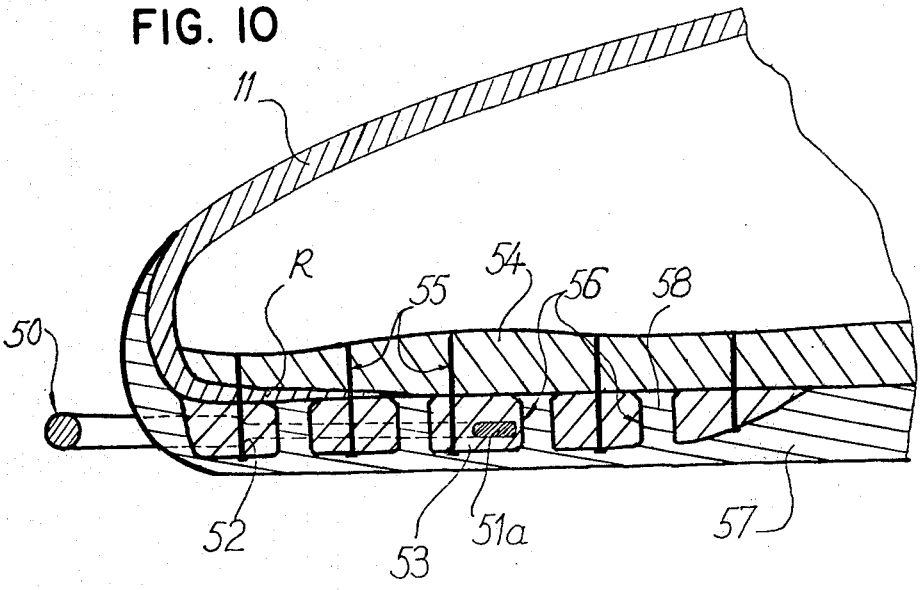
FIG. 10 is a cross-sectional view illustrating the front of a third embodiment of a cross-country or a mountaineering boot.

In FIG. 10, the intermediate element which comprises 50 comprises a support 53 made out of plastic material identical to that of FIG. 9 and molded around the flattened zone 52 of the inlaid element 50, Support 53 is attached by means such as nails or staples 55 under the front of the first sole 54. In this case, the bent-down edge R of the upper portion is squeezed between the support and the first sole, which obviates the necessity of providing the slots 26 at the lower front of the upper portion of FIG. 7.

The support 53 equally comprises holes 56 which may be filled with the material 58 which is molded thereon and which constitutes the walking sole 57.

Figure 11:
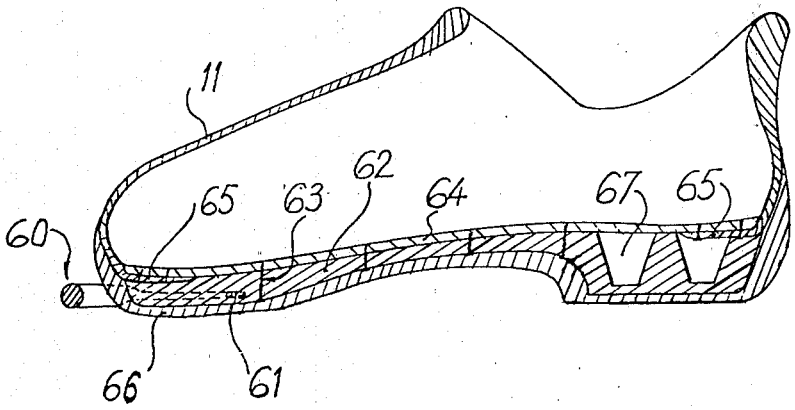
FIG. 11 illustrates in longitudinal cross-section a fourth embodiment of a cross-country ski boot or a cross-country ski boot.

FIG. 11 illustrates an alternative embodiment of FIG. 10 in which the intermediate element is there also constituted by a first sole 64 connected by nails 63 to a support in which is anchored the planar portion 61 of the inlaid element.

Edge 65 of the upper portion is held between the support and the first sole as in the case of FIG. 10.

However, in contrast with the embodiment illustrated in FIG. 10, the support 62 in this instance occupies the entire inner surface of the boot. If desired, the heel portion of the support may be lightened by providing cavities 67 therein. The walking sole 66 is molded on the assembly so as to ensure the mechanical cohesion thereof as well as to provide for a good seal.

Although the invention has been described with respect to particular means and materials, it is to be understood that the invention is not limited to the particulars disclosed, but extends to cover all alternative and equivalent elements, means and steps falling within the scope of the claims.

Thus, although the invention has been described with particular reference to boots, it is to be understood that the invention extends to all shoes, boots, and the like in which a projecting portion is to be used.

Furthermore, although the projecting portion has been illustrated as being rectangular, and of a generally planer configuration, this need not be the case as noted in the previously referenced Patent Application in which the projecting portion need not be planer. Likewise, a rectangular configuration need not necessarily be used.

Finally, although the invention has been described particularly with respect to cross-country and mountaineering skiing, it is to be understood that the invention finds particular application whenever the boot is used in conjunction with a ski binding wherein it is desired to be able to lift the heel from the ski for purposes of walking or the like.

What is claimed is:

1. Process of making a boot or shoe for use in sports comprising an upper portion, a walking sole joined at its periphery to said upper portion at a junction, an intermediate element positioned between said walking sole and the region adapted to receive the foot of the user, and at least one portion projecting beyond said junction to the outside of said boot or shoe, said process comprising the steps of:

(a) integrating said projecting portion and said intermediate element to form an integral assembly; and (b) integrating said integrating assembly with said upper portion and said walking sole to form said shoe.

2. The process as defined by claim 1 wherein said projecting portion is part of an inlaid element and said process further comprises inlaying said inlaid element within said intermediate element whereby a portion of said inlaid element is inlaid within said intermediate element and said projecting portion of said inlaid element protrudes beyond said junction.

3. The process as defined by claim 2 wherein said intermediate element comprises a seat adapted to receive the inlaid portion of said inlaid element and said process further comprises mechanically securing said inlaid portion within said seat.

4. The process as defined by claim 2 further comprising molding said intermediate element so as to encase said inlaid portion of said inlaid element therein.

5. The process as defined by any of claims 1, 2, 3 or 4 comprising molding said walking sole around said intermediate element comprising said inlaid element.

6. The process as defined by claim 1 further comprising slitting the lower front of said upper portion to provide at least one slit whereby said lower front may be at least partially folded under said intermediate element.

7. The process as defined by claim 1 wherein said shoe or boot comprises a first sole and said process comprises folding the lower front of said upper portion between said first sole and said intermediate element.

8. The process as defined by claim 7 wherein said intermediate element comprises a support upon which said projecting portion is mounted.

9. The process as defined by claim 7 comprising molding said walking sole around said lower front portion.

10. The process as defined by claim 7 wherein said intermediate element extends over the entire length of said shoe or boot.

11. The process as defined by claim 10 wherein said intermediate element comprises at least one cavity.

12. A boot or shoe for use in sports, said boot or shoe comprising:

(a) an upper portion;

(b) a walking sole joined at a junction to said upper portion;

(c) an intermediate element positioned between said walking sole and a space provided for the foot of a user; and (d) a projecting portion adapted to project beyond said junction to the outside of said boot or shoe, said projecting portion being mounted directly upon said intermediate element.

13. The boot or shoe as defined by claim 12 wherein said projecting element is part of an inlaid element, said inlaid element comprising an inlaid portion inlaid within said intermediate element.

14. The boot or shoe defined by claim 13 wherein said intermediate element comprises a seat adapted to receive said inlaid portion of said inlaid element and means for integrally securing said inlaid portion to said intermediate element.

15. The boot or shoe as defined by claim 14 wherein said intermediate element is molded around said inlaid portion.

16. The boot or shoe as defined by claim 15 wherein said intermediate element comprises a first sole.

17. The boot or shoe as defined by claim 11 wherein said intermediate element further comprises an auxiliary support positioned between said first sole and said walking sole.

18. The boot or shoe as defined by claim 17 wherein said intermediate element is integrally joined to said upper portion and to said walking sole.

19. The boot or shoe as defined by claim 12 wherein said walking sole is molded around said upper portion, and said intermediate element comprises at least one cavity adapted for securing said intermediate element to said walking sole.

20. The boot or shoe defined by claim 13 wherein said inlaid portion is secured within said front portion of said intermediate element positioned at the front of said shoe or boot, and wherein said projecting element is positioned substantially in the plane of said intermediate element and extends along the longitudinal axis of said boot or shoe.

21. The boot or shoe as defined by claim 20 wherein the lower front portion of said upper portion comprises at least one slit whereby a portion of said lower frontal zone may be folded under said intermediate element without the formation of folds or wrinkles.

22. The boot or shoe as defined by claim 18 wherein the lower frontal zone of said upper portion comprises at least one slit whereby a portion of said lower frontal zone may be folded under said first sole.

23. The boot or shoe defined by claim 12 in combination with a cross-country ski-binding or a mountainer-type ski-binding, said binding comprising a bearing adapted to seat said projecting element, and wherein said projecting element is rigid and defines a plane having an opening extending through the plane of said projecting element.

24. The combination as defined by claim 23 wherein said inlaid element comprises an elongated inlaid portion, and wherein said projecting portion is generally U-shaped so as to comprise two longitudinal branches connected by one transverse branch.

25. The combination as defined by claim 24 wherein said projecting portion has a generally circular cross-section adapted to be seated in said bearing.

26. The combination as defined by any one of claims 24 or 25 wherein said inlaid element is a generally rectangular ring.

27. The combination as defined by claim 26 wherein said inlaid portion has a flattened cross-section.

28. The boot or shoe as defined by claim 12 wherein said projecting comprises climbing spurs.

29. The boot or shoe as defined by claim 20 further comprising a first sole arranged upon said intermediate element and wherein the lower front of said upper portion is folded under said intermediate element so as to be positioned between said first sole and said intermediate element.

30. The boot or shoe as defined by claim 29 wherein said lower front portion is positioned above said projecting portion.

31. The boot or shoe as defined by claim 30 wherein said walking sole is molded around said lower front portion.

32. The boot or shoe as defined by claim 31 wherein said intermediate element comprises a support on which said projecting portion is mounted.

33. The boot or shoe as defined by claim 31 wherein said intermediate element extends over the entire length of said shoe or boot.

34. The boot or shoe as defined by claim 33 wherein said intermediate element comprises at least one cavity.

35. The boot or shoe as defined by claim 7 wherein said intermediate element is joined to said upper portion and said walking sole.

* * * * *